US010549949B2

(12) United States Patent
Kato

(10) Patent No.: US 10,549,949 B2
(45) Date of Patent: Feb. 4, 2020

(54) ELEVATOR DERAILMENT DETECTION DEVICE

(71) Applicant: MITSUBISHI ELECTRIC CORPORATION, Chiyoda-ku (JP)

(72) Inventor: Kunio Kato, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 193 days.

(21) Appl. No.: 15/740,126

(22) PCT Filed: Aug. 28, 2015

(86) PCT No.: PCT/JP2015/074467
§ 371 (c)(1),
(2) Date: Dec. 27, 2017

(87) PCT Pub. No.: WO2017/037787
PCT Pub. Date: Mar. 9, 2017

(65) Prior Publication Data

US 2018/0194594 A1 Jul. 12, 2018

(51) Int. Cl.
*B66B 1/34* (2006.01)
*B66B 5/00* (2006.01)
(Continued)

(52) U.S. Cl.
CPC ..... *B66B 5/0031* (2013.01); *B66B 5/022* (2013.01); *B66B 7/02* (2013.01)

(58) Field of Classification Search
CPC ..... B66B 5/0031; B66B 5/022; B66B 7/02
(Continued)

(56) References Cited

U.S. PATENT DOCUMENTS 4,096,925 A * 6/1978 Koob ..... B66B 1/50 187/278
4,102,437 A * 7/1978 Mandel ..... B66B 3/02 187/399
(Continued)

FOREIGN PATENT DOCUMENTS

JP 53-145668 U 12/1978
JP 59-102777 A 6/1984
(Continued)

OTHER PUBLICATIONS

International Search Report dated Dec. 1, 2015 in PCT/JP2015/074467, filed Aug. 28, 2015.

*Primary Examiner* — Anthony J Salata
(74) *Attorney, Agent, or Firm* — Xsensus LLP

(57) ABSTRACT

A derailment detection apparatus for an elevator includes a conductive line, an upper support device configured to support an upper end portion of the conductive line, a lower support device configured to support a lower end portion of the conductive line, a contact element, which is installed on an ascending/descending body, and is brought into contact with the conductive line when the ascending/descending body derails from guide rail, and a detection unit configured to detect contact of the contact element with the conductive line. The lower support device is fixed to the guide rail by fastening a fastener, and is allowed to move upward and downward along the guide rail by loosening the fastener. The lower support device includes a guide portion configured to guide upward and downward movement of the lower support device along the guide rail.

4 Claims, 11 Drawing Sheets

(51) Int. Cl.
*B66B 5/02* (2006.01)
*B66B 7/02* (2006.01)

(58) Field of Classification Search
USPC ..... 187/247, 250, 277, 278, 390–394, 406, 187/414
See application file for complete search history.

(56) References Cited

U.S. PATENT DOCUMENTS

| | | | | | |
|---|---|---|---|---|---|
| 4,106,594 | A * | 8/1978 | Kirsch | B66B 5/022 | 187/278 |
| 4,643,276 | A * | 2/1987 | Philobos | B66B 5/022 | 187/278 |
| 4,998,601 | A * | 3/1991 | Suzuki | B66B 5/022 | 187/278 |
| 8,973,715 | B2 * | 3/2015 | Quinn | B66B 5/022 | 187/278 |
| 9,033,113 | B2 * | 5/2015 | Winey | B66B 5/022 | 187/278 |
| 2012/0024636 | A1 | 2/2012 | Niikawa | | |
| 2017/0233222 | A1 * | 8/2017 | Puranen | B66B 1/30 | 187/247 |
| 2019/0039860 | A1 * | 2/2019 | Sato | B66B 5/02 | |

FOREIGN PATENT DOCUMENTS

| | | | |
|---|---|---|---|
| JP | 06-255927 | A | 9/1994 |
| JP | 2003-321169 | A | 11/2003 |
| JP | 2011-116545 | A | 6/2011 |
| WO | 2011/010376 | A1 | 1/2011 |

* cited by examiner

ELEVATOR DERAILMENT DETECTION DEVICE

TECHNICAL FIELD

The present invention relates to a derailment detection apparatus for an elevator, which is configured to detect derailment of an ascending/descending body from a guide rail due to an earthquake or the like.

BACKGROUND ART

In a related-art derailment detection apparatus for an elevator, first and second conductive lines are stretched in parallel to counterweight guide rails. Contact arms each are mounted to a counterweight so as to be opposed to the first and second conductive lines. Each of the contact arms is brought into contact with the first or the second conductive line when the counterweight is displaced forward, backward, rightward, or leftward. Contact of each of the contact arms with the first or the second conductive line is detected by a detection unit (for example, see Patent Literature 1).

Further, in another related-art derailment detection apparatus, first and second contact elements are installed on a counterweight. The first contact element surrounds a first conductive line, and is brought into contact with the first conductive line when the counterweight derails from counterweight guide rails. The second contact element surrounds a second conductive line, and is brought into contact with the second conductive line when the counterweight derails from the counterweight guide rails. Further, the first conductive line is set at a positive potential, and the second conductive line is set at a ground potential. A detection unit detects derailment of an ascending/descending body from the guide rails based on whether or not conduction between the first contact element and the first conductive line is established (for example, see Patent Literature 2).

CITATION LIST

Patent Literature

[PTL 1] JP 53-145668 U
[PTL 2] WO 2011/010376 A1

SUMMARY OF THE INVENTION

Problem to be Solved by the Invention

In the related-art derailment detection apparatus described above, in order to apply tension to the conductive line, a threaded bar is connected to each of an upper end portion and a lower end portion of the conductive line. However, in order to apply tension having sufficient magnitude to the conductive line so as to prevent oscillation of the conductive line caused by raising and lowering a car, much time and labor are required during installation and maintenance. For example, when a raising and lowering stroke has a length of 60 m, it is required to pull a wire by a length of 460 mm. In a case of using a combination of a threaded bar and a nut of M12 size, it is required to turn the nut two hundred and sixty turns.

The present invention has been made to solve the above-mentioned problem, and has an object to provide a derailment detection apparatus for an elevator, which is capable of easily applying sufficient tension to a conductive line, and of enhancing workability of installation and maintenance.

Means for Solving the Problem

According to one embodiment of the present invention, there is provided a derailment detection apparatus for an elevator, which is configured to detect derailment, from a guide rail, of an ascending/descending body guided along the guide rail to be raised and lowered, the derailment detection apparatus including: a conductive line stretched inside a hoistway in parallel to a raising and lowering direction of the ascending/descending body; an upper support device configured to support upper end portion of the conductive line; a lower support device configured to support a lower end portion of the conductive line; a contact element, which is installed on the ascending/descending body, and is brought into contact with the conductive line when the ascending/descending body derails from the guide rail; and a detection unit configured to detect contact of the contact element with the conductive line the lower support device being fixed to the guide rail by fastening a fastener, and being allowed to move upward and downward along the guide rail by loosening the fastener, the lower support device including a guide portion configured to guide upward and downward movement of the lower support device along the guide rail.

Effects of the Invention

In the derailment detection apparatus for an elevator according to the present invention, the lower support device includes the guide portion. Accordingly, when the fastener is loosened, the lower support device can easily be pushed down along the guide rail. Thus, sufficient tension can easily be applied to the conductive line, and workability of installation and maintenance can be enhanced.

DESCRIPTION OF EMBODIMENTS

Now, embodiments of the present invention are described with reference to the drawings.

First Embodiment

Figure 1:
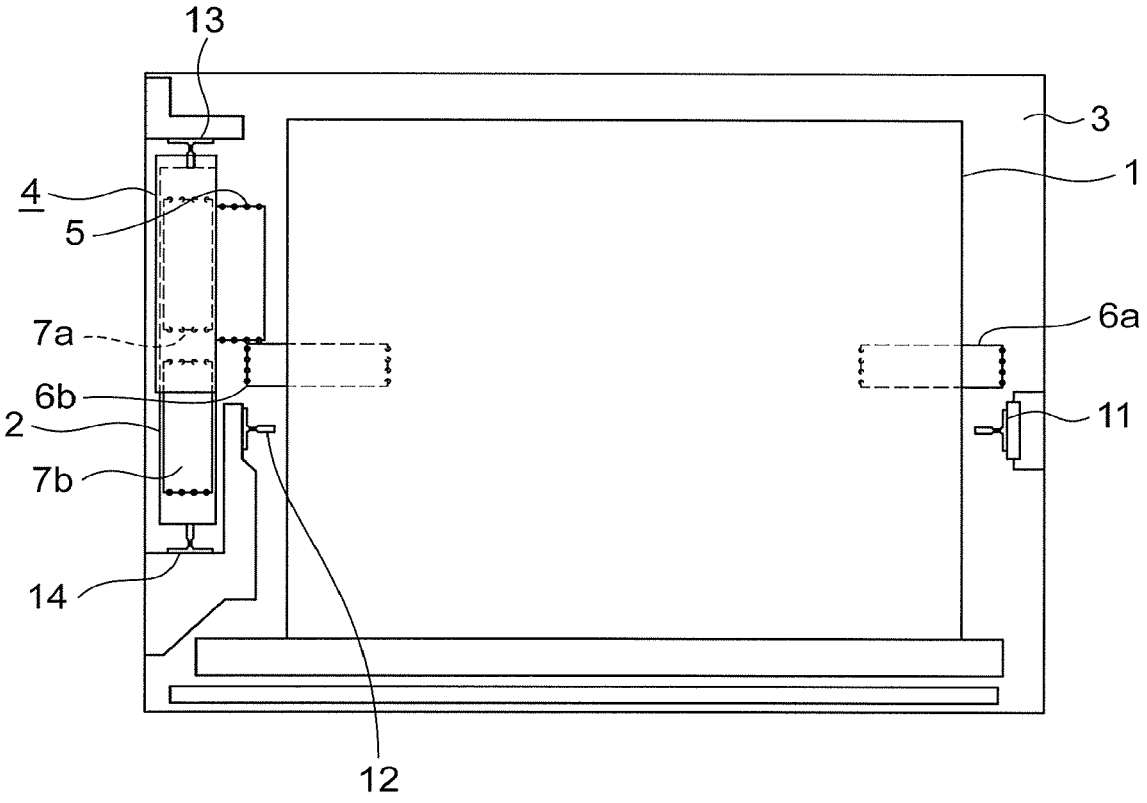
FIG. 1 is a plan view for illustrating an elevator of a first embodiment of the present invention.

FIG. 1 is a plan view for illustrating an elevator of a first embodiment of the present invention. In FIG. 1, a car 1 and a counterweight 2 are suspended in a hoistway 3 by a suspension body (not shown). As the suspension body, a plurality of ropes or a plurality of belts are used.

In an upper portion of the hoistway 3, a hoisting machine 4 configured to raise and lower the car 1 and the counterweight 2 is installed. The hoisting machine 4 includes a drive sheave 5, a motor (not shown) configured to rotate the drive sheave 5, and a brake (not shown) configured to brake the rotation of the drive sheave 5. Further, the hoisting machine 4 is arranged directly above the counterweight 2.

First and second car suspension pulleys 6*a* and 6*b* are arranged on a lower portion of the car 1. The first and second car suspension pulleys 6*a* and 6*b* are arranged apart from each other in a width direction of the car 1, that is, in a right-and-left direction of FIG. 1.

First and second counterweight suspension pulleys 7*a* and 7*b* are arranged on an upper portion of the counterweight 2. The first and second counterweight suspension pulleys 7*a* and 7*b* are arranged apart from each other in a width direction of the counterweight 2, that is, in an up-and-down direction of FIG. 1.

The suspension body includes first and second suspension body end portions connected to the upper portion of the hoistway 3. Further, the suspension body is wound around the first car suspension pulley 6*a*, the second car suspension pulley 6*b*, the drive sheave 5, the first counterweight suspension pulley 7*a*, and the second counterweight suspension pulley 7*b* in the stated order from the first suspension body end portion to reach the second suspension body end portion. That is, the car 1 and the counterweight 2 are suspended by a two-to-one (2:1) roping method.

Inside the hoistway 3, there are installed first and second car guide rails 11 and 12 configured to guide the raising and lowering of the car 1, and first and second counterweight guide rails 13 and 14 configured to guide the raising and lowering of the counterweight 2.

Figure 2:
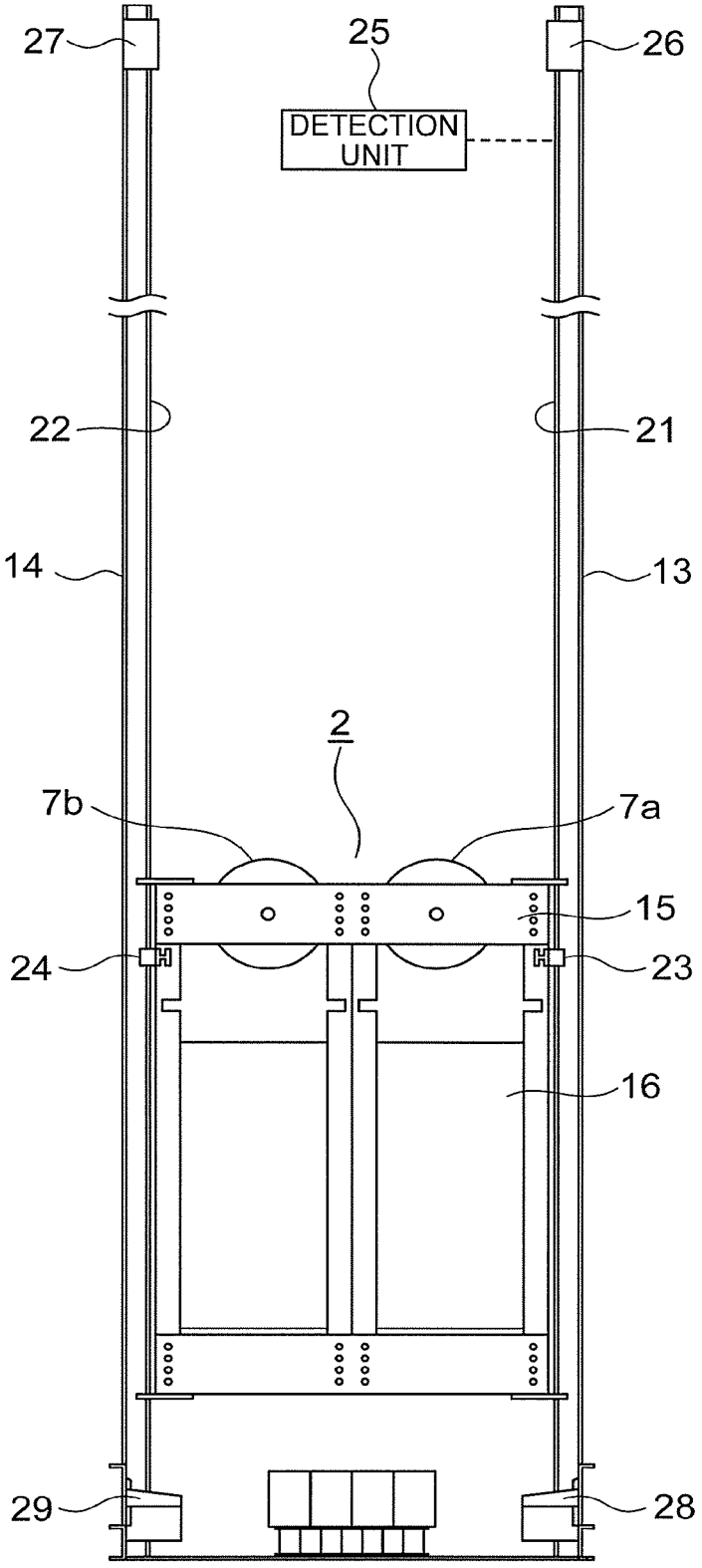
FIG. 2 is a back view for illustrating a counterweight and peripheral devices of FIG. 1.
Figure 3:
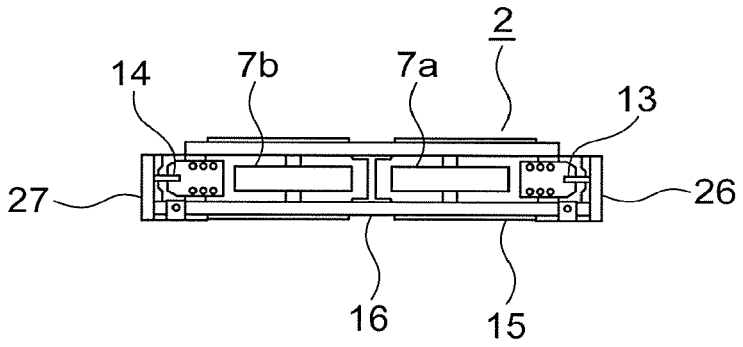
FIG. 3 is a plan view for illustrating the counterweight and the peripheral devices of FIG. 2.
Figure 4:
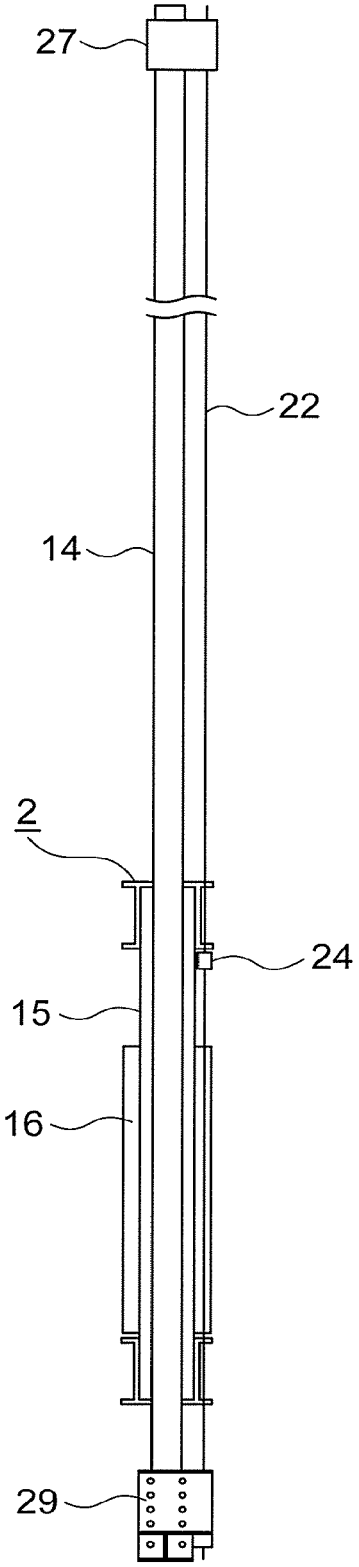
FIG. 4 is a side view for illustrating the counterweight and the peripheral devices of FIG. 2.
Figure 5:
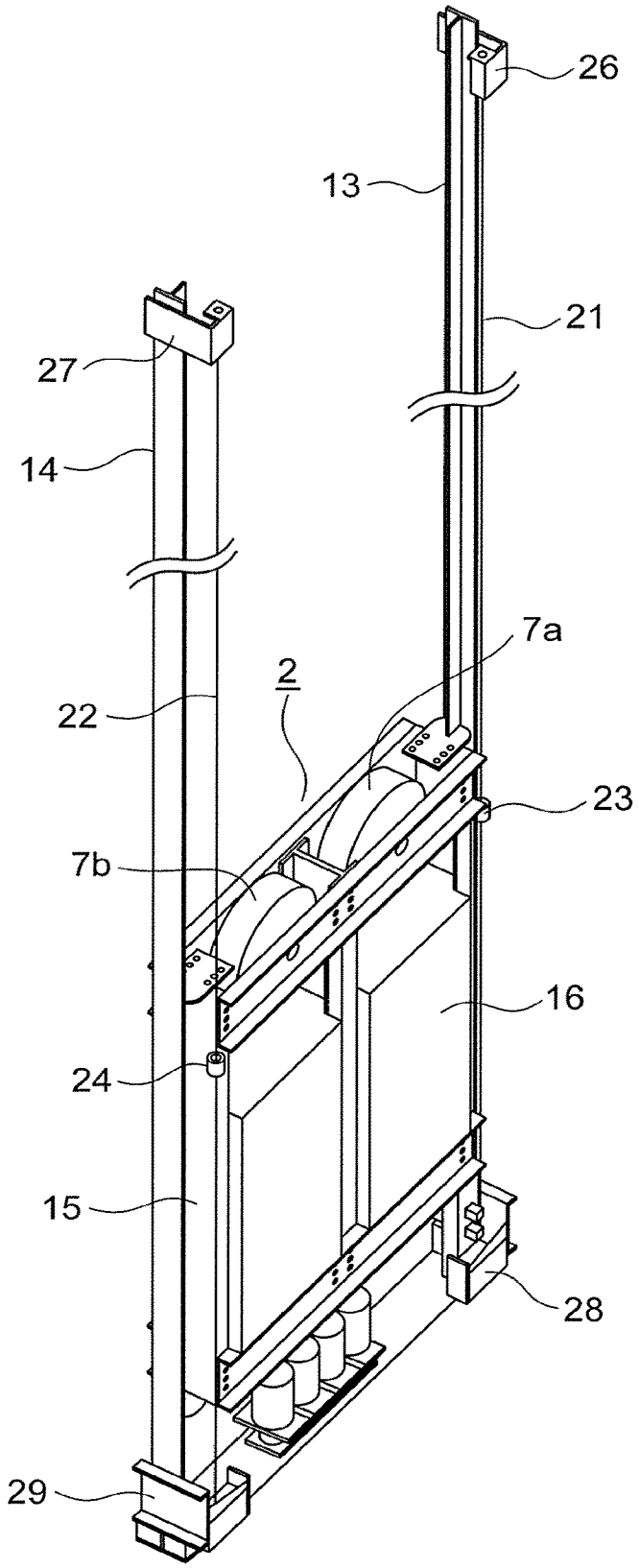
FIG. 5 is a perspective view for illustrating the counterweight and the peripheral devices of FIG. 2.

FIG. 2 is a back view for illustrating the counterweight 2 and peripheral devices of FIG. 1. FIG. 3 is a plan view for illustrating the counterweight 2 and the peripheral devices of FIG. 2. FIG. 4 is a side view for illustrating the counterweight 2 and the peripheral devices of FIG. 2. FIG. 5 is a perspective view for illustrating the counterweight 2 and the peripheral devices of FIG. 2.

The counterweight 2 includes a frame body 15 made of metal, and a plurality of weight bodies 16 stacked in the frame body 15. The first and second counterweight suspension pulleys 7*a* and 7*b* are arranged on an upper portion of the frame body 15.

First and second conductive lines 21 and 22 are stretched inside the hoistway 3. The first and second conductive lines 21 and 22 are arranged over an entire length of a raising and lowering stroke of the counterweight 2 in parallel to a direction of raising and lowering the counterweight 2, that is, in a vertical direction. As each of the first and second conductive lines 21 and 22, a conductive wire is used.

Further, the first conductive line 21 is arranged alongside the first counterweight guide rail 13 near one end portion of the counterweight 2 in the width direction. The second conductive line 22 is arranged alongside the second counterweight guide rail 14 near the other end portion of the counterweight 2 in the width direction.

A first contact element 23 is fixed to one side of the frame body 15 in the width direction. The first contact element 23 includes a first cylindrical portion. The first conductive line 21 is caused to pass through a center of the first cylindrical portion. That is, the first contact element 23 surrounds the first conductive line 21.

A second contact element 24 is fixed to the other side of the frame body 15 in the width direction. The second contact element 24 includes a second cylindrical portion. The second conductive line 22 is caused to pass through a center of the second cylindrical portion. That is, the second contact element 24 surrounds the second conductive line 22.

The first and second contact elements 23 and 24 are each made of a conductive material. Further, the first contact element 23 is electrically connected to the second contact element 24 through the frame body 15.

When the counterweight 2 derails from the counterweight guide rails 13 and 14 to be displaced in a horizontal direction, the first contact element 23 is brought into contact with the first conductive line 21, and the second contact element 24 is brought into contact with the second conductive line 22.

During normal operation of the elevator, the first conductive line 21 is set at a positive potential, and the second conductive line 22 is set at a ground potential. Although illustrated only in FIG. 2 by a block figure, a detection unit 25 configured to detect contact of the first contact element 23 with the first conductive line 21 is connected to the first conductive line 21.

The detection unit 25 is configured to detect derailment of the counterweight 2 from the counterweight guide rails 13 and 14 based on whether or not conduction between the first contact element 23 and the first conductive line 21 is established. Further, as the detection unit 25, for example, a potential detector configured to detect the potential of the first conductive line 21 is used.

A first upper support device 26 configured to support an upper end portion of the first conductive line 21 is fixed to an upper end portion of the first counterweight guide rail 13. A second upper support device 27 configured to support an upper end portion of the second conductive line 22 is fixed to an upper end portion of the second counterweight guide rail 14.

A first lower support device 28 configured to support a lower end portion of the first conductive line 21 is fixed to a lower end portion of the first counterweight guide rail 13. A second lower support device 29 configured to support a lower end portion of the second conductive line 22 is fixed to a lower end portion of the second counterweight guide rail 14.

A derailment detection apparatus according to the first embodiment includes the first conductive line 21, the second conductive line 22, the first contact element 23, the second contact element 24, the detection unit 25, the first upper support device 26, the second upper support device 27, the first lower support device 28, and the second lower support device 29. Further, an ascending/descending body, which is a derailment detection object, is the counterweight 2.

Figure 6:
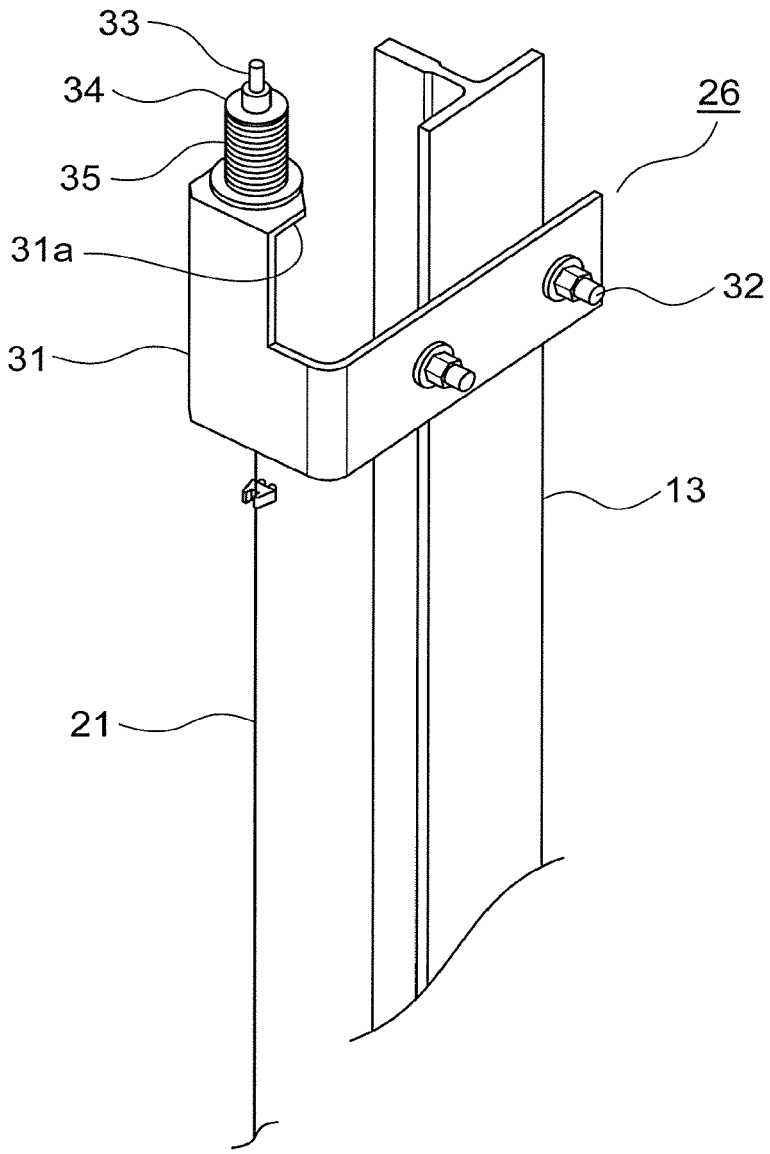
FIG. 6 is a perspective view for illustrating a first upper support device of FIG. 5 in an enlarged manner.

FIG. 6 is a perspective view for illustrating the first upper support device 26 of FIG. 5 in an enlarged manner. The first upper support device 26 includes an upper support bracket 31, a pair of upper fasteners 32, an upper rod 33, an upper spring bearing 34, and an upper spring 35.

The upper support bracket 31 is fixed to the upper end portion of the first counterweight guide rail 13 by fastening the upper fasteners 32. The upper support bracket 31 includes a horizontal portion 31*a*.

The upper end portion of the first conductive line 21 is connected to a lower end portion of the upper rod 33. A middle portion of the upper rod 33 passes through the horizontal portion 31*a*. An upper end portion of the upper rod 33 passes through the upper spring bearing 34. A threaded portion is formed in the upper end portion of the upper rod 33, and a plurality of nuts configured to prevent the upper spring bearing 34 from slipping off are fastened to the threaded portion.

The upper spring 35 is interposed and compressed between the horizontal portion 31*a* and the upper spring bearing 34. The second upper support device 27 has the same configuration as that of the first upper support device 26.

Figure 7:
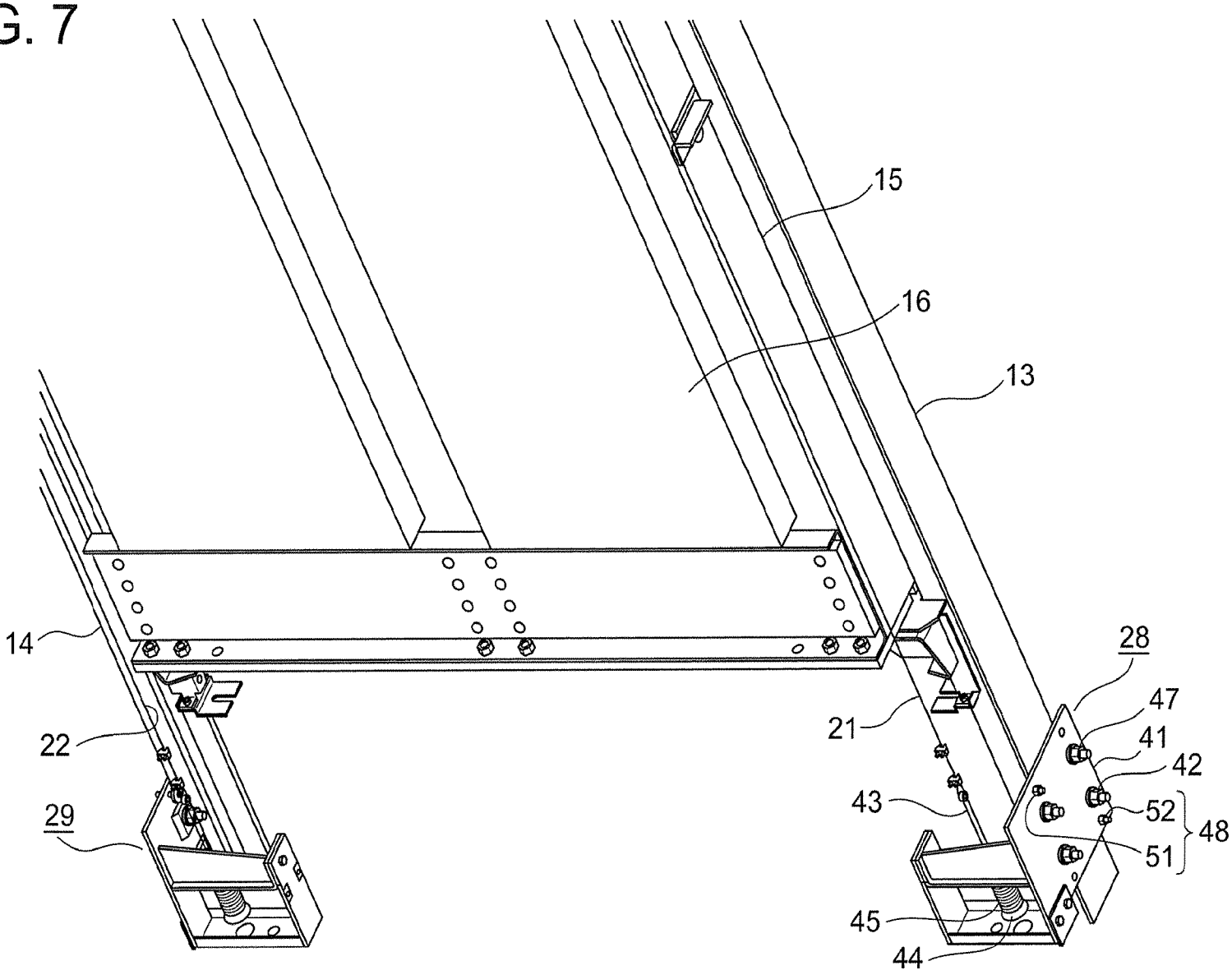
FIG. 7 is a perspective view for illustrating first and second lower support devices of FIG. 5.
Figure 8:
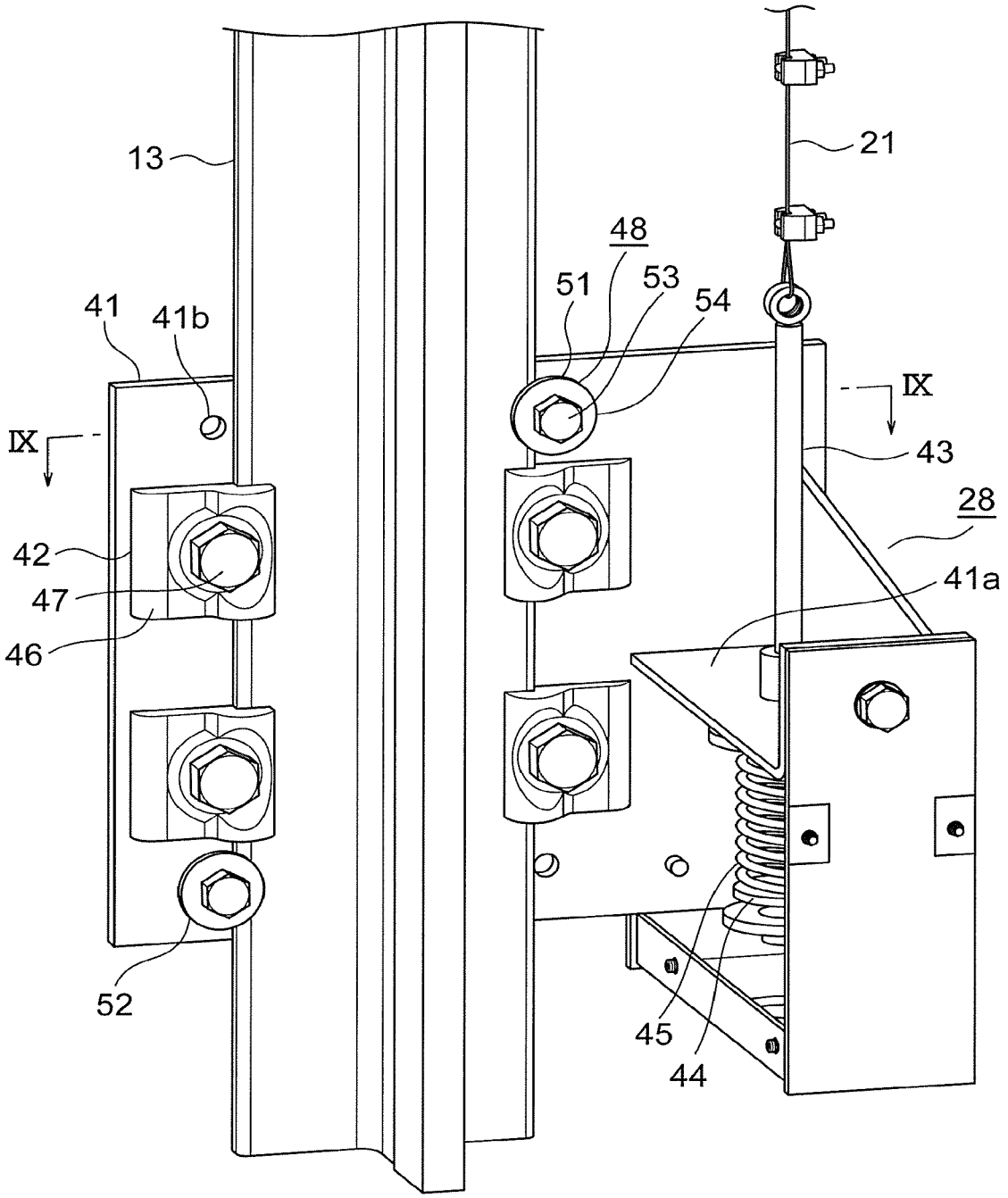
FIG. 8 is a perspective view for illustrating the first lower support device of FIG. 7 in an enlarged manner.
Figure 9:
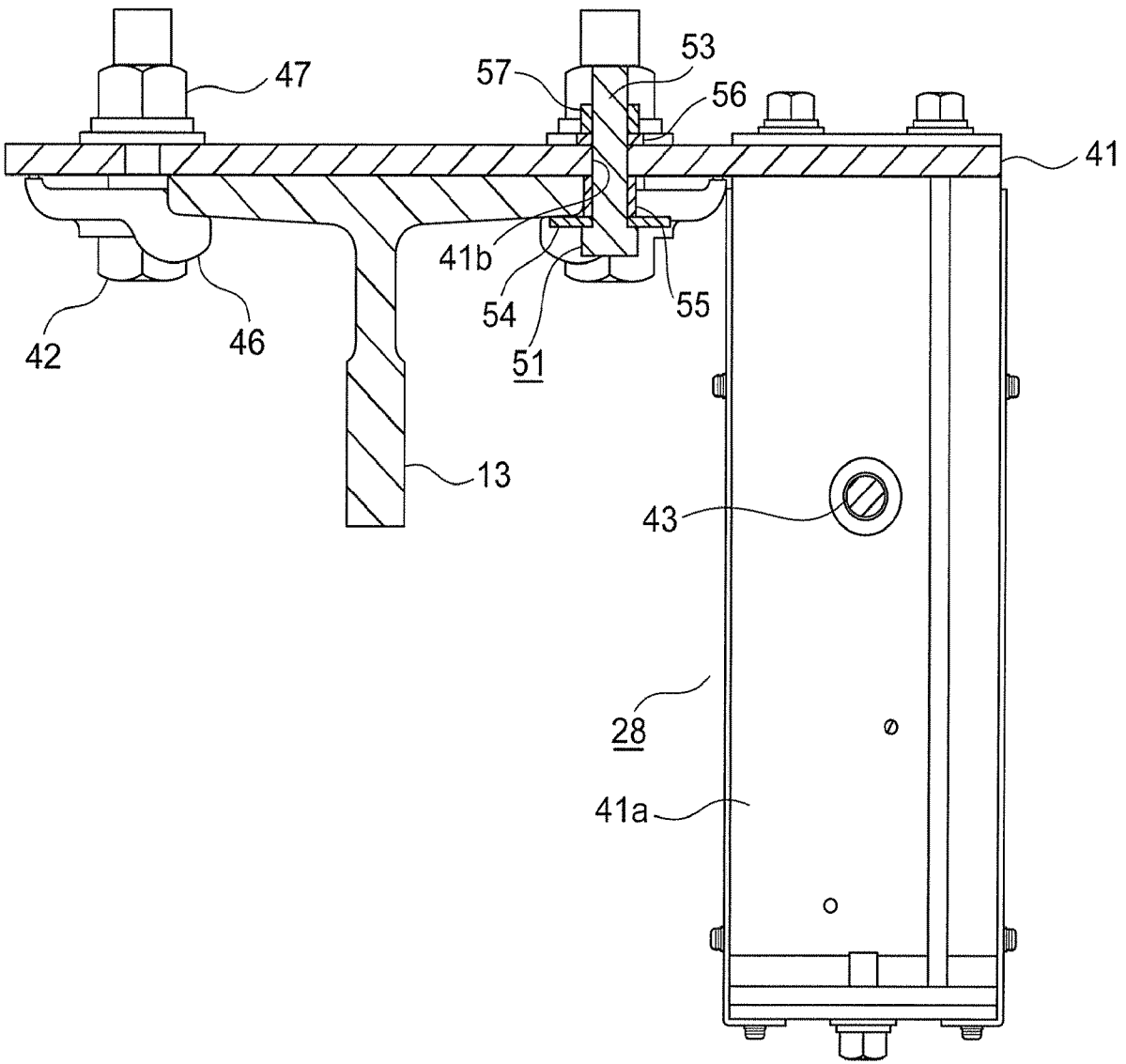
FIG. 9 is a sectional view taken along the line IX-IX of FIG. 8.

FIG. 7 is a perspective view for illustrating the first and second lower support devices 28 and 29 of FIG. 5. FIG. 8 is a perspective view for illustrating the first lower support device 28 of FIG. 7 in an enlarged manner. FIG. 9 is a sectional view taken along the line IX-IX of FIG. 8. The first lower support device 28 includes a lower support device main body 41, two pairs of lower fasteners 42, a lower rod 43, a lower spring bearing 44, and a lower spring 45.

The lower support device main body 41 is fixed at a vicinity of the lower end portion of the first counterweight guide rail 13 by fastening the lower fasteners 42. The lower fasteners 42 each include a rail clip 46 configured to sandwich an end portion of the first counterweight guide rail 13 in the width direction together with the lower support device main body 41, and a fastener 47 configured to fasten the rail clip 46 to the lower support device main body 41. As the fastener 47, a combination of a bolt and a nut is used.

The lower support device main body 41 includes a horizontal portion 41*a*. The lower end portion of the first conductive line 21 is connected to an upper end portion of the lower rod 43. A middle portion of the lower rod 43 passes through the horizontal portion 41*a*. A lower end portion of the lower rod 43 passes through the lower spring bearing 44. A threaded portion is formed in the lower end portion of the lower rod 43, and a plurality of nuts configured to prevent the lower spring bearing 44 from slipping off are fastened to the threaded portion.

The lower spring 45 is interposed and compressed between the horizontal portion 41*a* and the lower spring bearing 44.

When the lower fasteners 42 are loosened, the first lower support device 28 can be moved upward and downward along the first counterweight guide rail 13. Further, the first lower support device 28 includes a guide portion 48 configured to guide upward and downward movement of the first lower support device 28 along the first counterweight guide rail 13.

The guide portion 48 allows the first lower support device 28 to move upward and downward, but inhibits the first lower support device 28 from moving in the horizontal direction and from turning about the first counterweight guide rail 13.

The guide portion 48 includes a first guide body 51 arranged on one side of the first counterweight guide rail 13 in the width direction, and a second guide body 52 arranged on the other side of the first counterweight guide rail 13 in the width direction at a position different and shifted from the position of the first guide body 51 in the up-and-down direction.

In this example, the second guide body 52 is arranged below the first guide body 51. That is, the first guide body 51 close to the first conductive line 21 is arranged above the second guide body 52 distant from the first conductive line 21. Further, the first and second guide bodies 51 and 52 are arranged at diagonal positions in a rectangular overlapping part between the lower support device main body 41 and the first counterweight guide rail 13.

Further, the first guide body 51 is mounted to the lower support device main body 41 at a position above a region where the lower fasteners 42 are mounted. Still further, the second guide body 52 is mounted to the lower support device main body 41 at a position below the region where the lower fasteners 42 are mounted.

As illustrated in FIG. 9, the first guide body 51 includes a guide bolt 53 being a shaft member, a first washer 54, a cylindrical roller 55, a second washer 56, and a nut 57. The guide bolt 53 is screwed from the first counterweight guide rail 13 side into a screw hole 41*b* formed in the lower support device main body 41.

The roller 55 is mounted to the guide bolt 53 so as to be rotatable about the guide bolt 53. An outer peripheral surface of the roller 55 abuts on an end surface of the first counterweight guide rail 13 in the width direction. The first washer 54 is interposed between a head of the guide bolt 53 and the roller 55. Further, the first washer 54 abuts on a surface on the counterweight 2 side of an end portion of the first counterweight guide rail 13 in the width direction. A fastening and loosening amount of the guide bolt 53 is adjusted to such an amount as to allow the roller 55 and the washer 54 to rotate.

The nut 57 is fastened to the guide bolt 53 on an opposite side of the first counterweight guide rail 13 with respect to the lower support device main body 41. With this configuration, the guide bolt 53 is fixed to the lower support device main body 41. The second washer 56 is interposed between the lower support device main body 41 and the nut 57 to prevent loosening.

The second guide body 52 has the same configuration as that of the first guide body 51. Further, the second lower support device 29 has the same configuration as that of the first lower support device 28, and the second lower support device 29 includes the similar guide portion 48.

In the derailment detection apparatus for an elevator described above, the lower support devices 28 and 29 each include the guide portions 48. Accordingly, when the lower fasteners 42 are loosened, the lower support devices 28 and 29 can easily be pushed down along the counterweight guide rails 13 and 14.

Specifically, even when a worker pushes down the lower support device main body 41 with, for example, his or her foot, under a state in which the lower fasteners 42 are loosened, the lower support devices 28 and 29 can stably be pushed down without involving turning of the lower support device main body 41 about the counterweight guide rails 13 and 14 and rattling of the lower support device main body 41 along the counterweight guide rails 13 and 14.

Accordingly, sufficient tension can easily be applied to the conductive lines 21 and 22. Thus, workability of installation and maintenance can be enhanced.

Further, the right and left guide bodies 51 and 52 are arranged at the diagonal positions shifted from each other in the up-and-down direction. Accordingly, the lower support devices 28 and 29 can easily be pushed down along the counterweight guide rails 13 and 14 with the small number of components.

In addition, the guide portion 48 including the guide bolt 53 and the roller 55 is used. Accordingly, the guide portion 48 can easily be installed only by forming the screw hole 41*b* in the lower support device main body 41. Thus, the guide portion 48 can easily be added also to an existing derailment detection apparatus.

Second Embodiment

Figure 10:
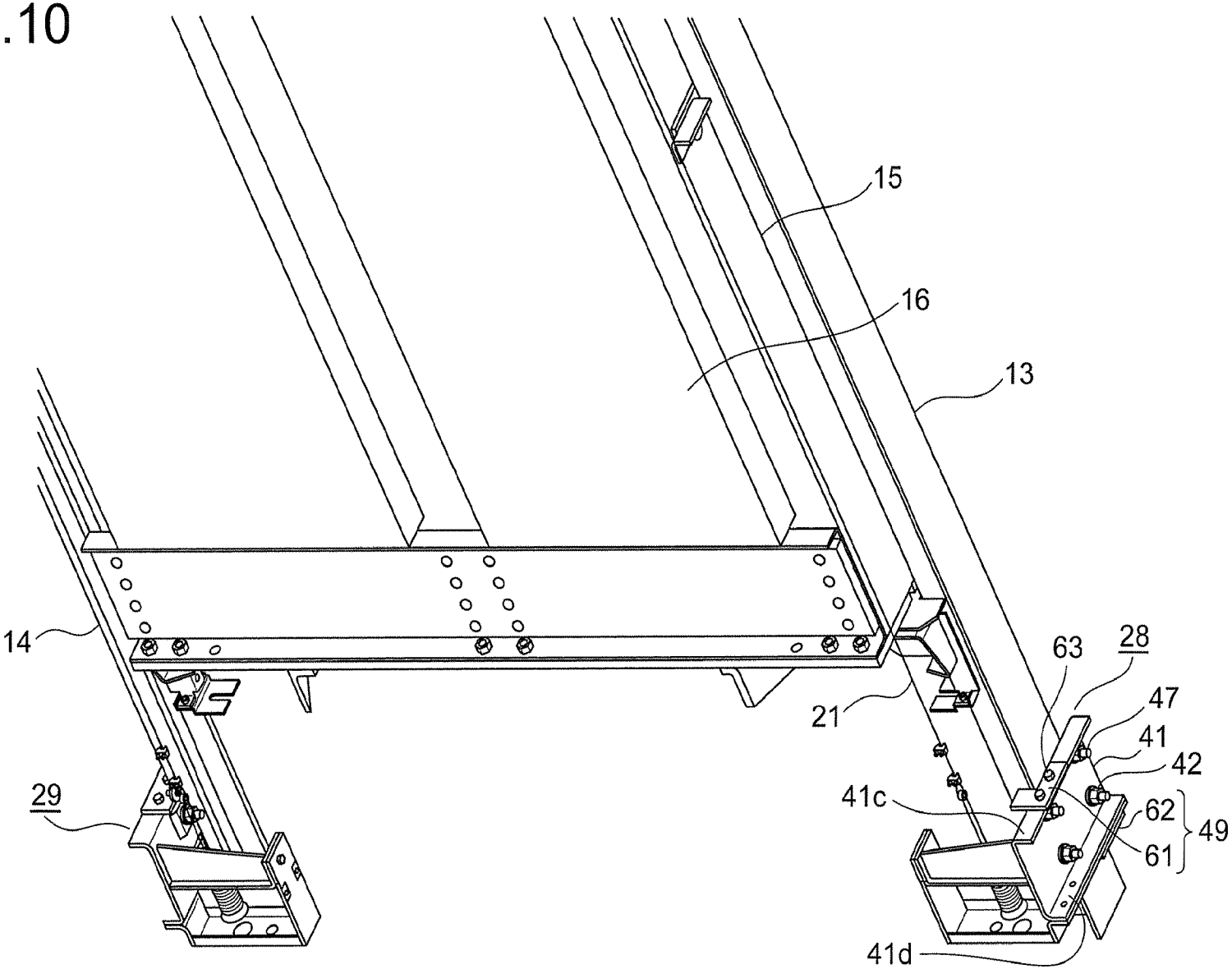
FIG. 10 is a perspective view for illustrating first and second lower support devices of a derailment detection apparatus according to a second embodiment of the present invention.
Figure 11:
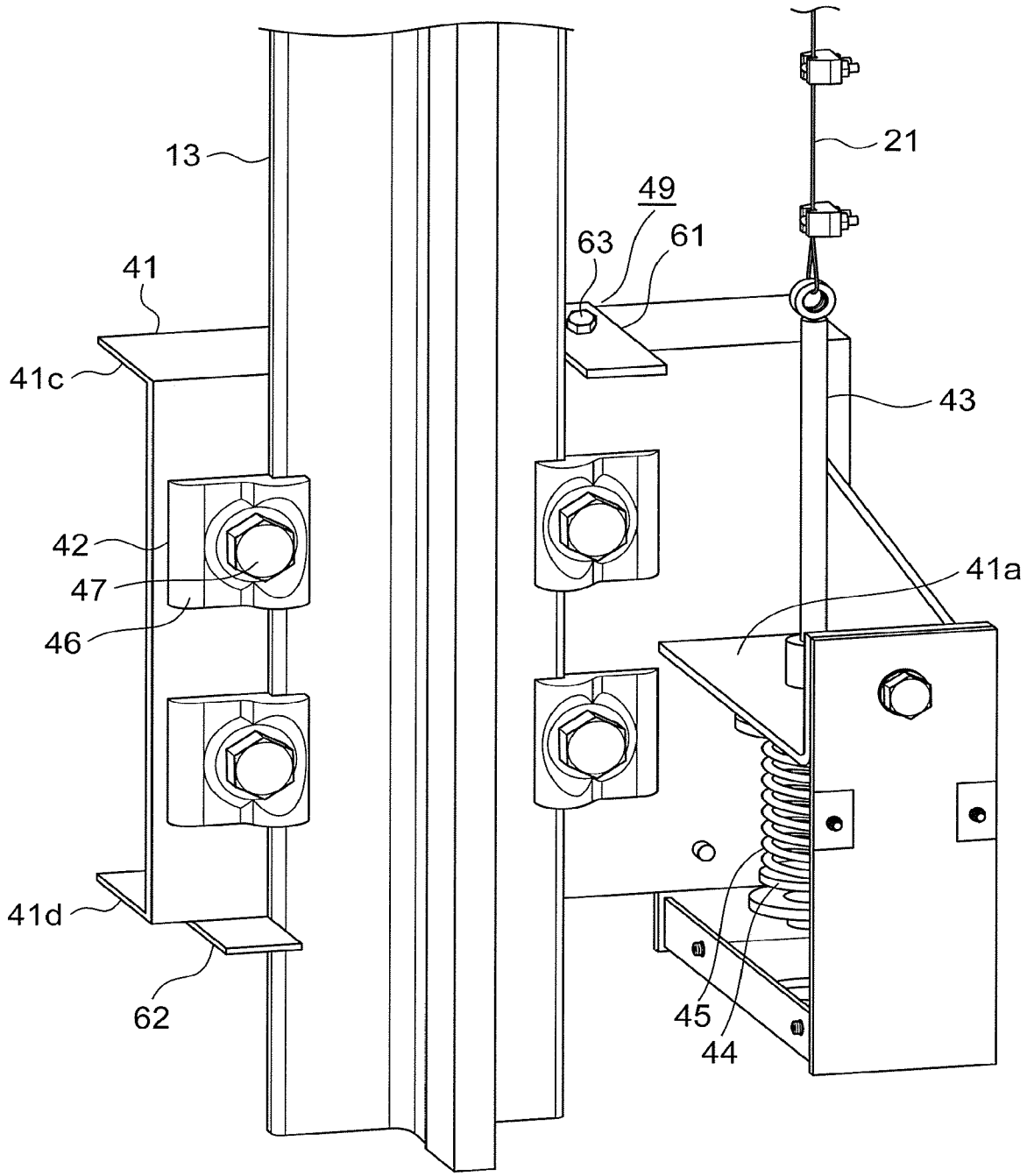
FIG. 11 is a perspective view for illustrating the first lower support device of FIG. 10 in an enlarged manner.

Next, FIG. 10 is a perspective view for illustrating the first and second lower support devices 28 and 29 of a derailment detection apparatus according to a second embodiment of the present invention, and FIG. 11 is a perspective view for illustrating the first lower support device 28 of FIG. 10 in an enlarged manner. The first lower support device 28 includes a guide portion 49 configured to guide upward and downward movement of the first lower support device 28 along the first counterweight guide rail 13.

The guide portion 49 allows the first lower support device 28 to move upward and downward, but inhibits the first lower support device 28 from moving in the horizontal direction and from turning about the first counterweight guide rail 13.

The guide portion 49 includes an L-shaped first guide plate 61 being the first guide body, and an L-shaped second guide plate 62 being the second guide body. The first guide plate 61 is arranged on one side of the first counterweight guide rail 13 in the width direction. The second guide plate 62 is arranged on the other side of the first counterweight guide rail 13 in the width direction at a position different and shifted from the position of the first guide plate 61 in the up-and-down direction.

In this example, the second guide plate 62 is arranged below the first guide plate 61. That is, the first guide plate 61 close to the first conductive line 21 is arranged above the second guide plate 62 distant from the first conductive line 21. Further, the first and second guide plates 61 and 62 are arranged at diagonal positions in a rectangular overlapping part between the lower support device main body 41 and the first counterweight guide rail 13.

Horizontal bent portions 41*c* and 41*d* are formed in upper and lower end portions of the lower support device main body 41 of the second embodiment, respectively. The first and second guide plates 61 and 62 are fixed to the bent portions 41*c* and 41*d*, respectively, with a plurality of bolts 63. The first guide plate 61 abuts on one end surface of the first counterweight guide rail 13 in the width direction. The second guide plate 62 abuts on the other end surface of the first counterweight guide rail 13 in the width direction. The second lower support device 29 also includes the similar guide portion 49. The other components are the same as those of the first embodiment.

Also in a case of using the guide portion 49 including the above-mentioned guide plates 61 and 62, when the lower fasteners 42 are loosened, the lower support devices 28 and 29 can easily be pushed down along the counterweight guide rails 13 and 14. Accordingly, sufficient tension can easily be applied to the conductive lines 21 and 22, and workability of installation and maintenance can be enhanced. Further, the configuration of the guide portion 49 can be simplified.

In the first embodiment and the second embodiment, the guide bodies 51 and 52 or the guide bodies 61 and 62 are arranged at the diagonal positions. However, right and left guide bodies may be arranged at the same height as long as the lower support devices 28 and 29 can stably be guided, for example, in a case of using guide bodies abutting on the counterweight guide rails 13 and 14 in a region having a certain length in the up-and-down direction.

Further, the guide portion may be constructed only by a single guide body, for example, in a case of using a guide body obtained by bending a flat plate into a C-shape in cross-section.

Still further, the guide portion may be constructed by three or more guide bodies. For example, the guide bodies 51 and 52 may be installed also in two unused screw holes 41*b* illustrated in FIG. 8.

Still further, the guide portion may be installed integrally with the lower support device main body.

Further, in the first embodiment and the second embodiment, the two conductive lines 21 and 22 are used. However, only a single conductive line may be used as long as derailment can be detected with only the single conductive line.

Still further, the ascending/descending body to be detected by the derailment detection apparatus according to the first embodiment is the counterweight 2. However, the ascending/descending body to be detected may be the car.

Still further, an entire layout of the elevator is not limited to the layout illustrated in FIG. 1. For example, the present invention is also applicable to a one-to-one roping elevator, an elevator including a hoisting machine arranged in a lower portion of a hoistway, an elevator using two or more counterweights, and the like.

Still further, the present invention is also applicable to elevator apparatus of various types, such as an elevator having a machine room, a machine room-less elevator, a double-deck elevator, and a one-shaft multi-car system elevator in which a plurality of cars are arranged in a common hoistway.

The invention claimed is:

1. A derailment detection apparatus for an elevator, which is configured to detect derailment, from a guide rail, of an ascending/descending body guided along the guide rail to be raised and lowered, the derailment detection apparatus comprising:

a conductive line stretched inside a hoistway in parallel to a raising and lowering direction of the ascending/descending body;

an upper support device configured to support upper end portions of the conductive line;

a lower support device configured to support lower end portion of the conductive line;

a contact element, which is installed on the ascending/descending body, and is brought into contact with the conductive line when the ascending/descending body derails from the guide rail; and a detection unit configured to detect contact of the contact element with the conductive line, wherein:

the lower support device is fixed to the guide rail by fastening a fastener, and is allowed to move upward and downward along the guide rail by loosening the fastener; and the lower support device comprises a guide portion configured to guide upward and downward movement of the lower support device along the guide rail.

2. The derailment detection apparatus for an elevator according to claim 1, wherein the guide portion comprises:

a first guide body arranged on one side of the guide rail in a width direction of the guide rail; and a second guide body arranged on the other side of the guide rail in the width direction at positions different and shifted from the positions of the first guide body in an up-and-down direction.

3. The derailment detection apparatus for an elevator according to claim 1, wherein the guide portion comprises:

a shaft member fixed to the lower support device; and a roller that is mounted around the shaft member so as to be rotatable and has an outer peripheral surface abutting on the guide rail.

4. The derailment detection apparatus for an elevator according to claim 2, wherein the guide portion comprises:

a shaft member fixed to the lower support device; and a roller that is mounted around the shaft member so as to be rotatable and has an outer peripheral surface abutting on the guide rail.

* * * * *